US009573008B1

(12) United States Patent
Fletcher

(10) Patent No.: US 9,573,008 B1
(45) Date of Patent: Feb. 21, 2017

(54) FIRE SUPPRESSION SYSTEM

(71) Applicant: Frank Fletcher, Clyman, WI (US)

(72) Inventor: Frank Fletcher, Clyman, WI (US)

( * ) Notice: Subject to any disclaimer, the term of this patent is extended or adjusted under 35 U.S.C. 154(b) by 0 days.

(21) Appl. No.: 14/869,413

(22) Filed: Sep. 29, 2015

(51) Int. Cl.

| | |
|---|---|
| ***A62C 37/00*** | (2006.01) |
| ***A62C 37/11*** | (2006.01) |
| ***A62C 35/13*** | (2006.01) |
| ***A62C 35/62*** | (2006.01) |
| ***A62C 35/68*** | (2006.01) |

(52) U.S. Cl.
CPC ..... *A62C 37/11* (2013.01); *A62C 35/13* (2013.01); *A62C 35/62* (2013.01); *A62C 35/68* (2013.01)

(58) Field of Classification Search
CPC ..... A62C 37/04; A62C 37/11
USPC ..... 169/16, 90, 56, 60, 61, 5, 26; 239/581.1
See application file for complete search history.

(56) References Cited

U.S. PATENT DOCUMENTS

| | | | | |
|---|---|---|---|---|
| 3,588,893 | A * | 6/1971 | Mc Closkey | G08B 17/00 169/23 |
| 3,752,235 | A * | 8/1973 | Witkowski | A62C 35/605 169/26 |
| 4,923,013 | A | 5/1990 | De Gennaro | |
| 6,819,237 | B2 * | 11/2004 | Wilson | G08B 17/00 169/46 |
| 7,673,696 | B1 | 3/2010 | Gunn | |
| 8,973,671 | B2 | 3/2015 | Alsaif et al. | |
| 2015/0021054 | A1 * | 1/2015 | McNamara | G05D 16/20 169/46 |

* cited by examiner

*Primary Examiner* — Arthur O Hall
*Assistant Examiner* — Tuongminh Pham
(74) *Attorney, Agent, or Firm* — Stevenson IP, LLC

(57) ABSTRACT

A fire suppression system including at least one heat-sensing device attached to a CPU-controlled sprinkler, which upon detection of a heat signature, activates the sprinkler to selectively dispense water from a fire sprinkler system pipe or a fire suppressant contained within a canister from a nozzle directly aimed at the source of the heat signature.

4 Claims, 5 Drawing Sheets

FIRE SUPPRESSION SYSTEM

BACKGROUND OF THE INVENTION

Various types of fire detection and suppression systems are known in the prior art. However, what is needed is a fire suppression system providing at least one central processing unit controlled sprinkler devised to activate upon the detection of a heat signature by a heat-sensing device, such as an infrared camera and a laser tracker, disposed on the sprinkler itself and to directly target the source of the heat signature for spraying with a nozzle on the sprinkler.

FIELD OF THE INVENTION

The present invention relates to fire detection and suppression systems, and more particularly, to a fire suppression system which provides at least one heat-sensing device attached to a CPU-controlled sprinkler, which upon detection of a heat signature, activates the sprinkler to selectively dispense water from a fire sprinkler system pipe or a fire suppressant contained within a canister from a nozzle directly aimed at the source of the heat signature.

SUMMARY OF THE INVENTION

The general purpose of the present fire suppression system, described subsequently in greater detail, is to provide a fire suppression system which has many novel features that result in a fire suppression system which is not anticipated, rendered obvious, suggested, or even implied by prior art, either alone or in combination thereof.

To accomplish this, the present fire suppression system devised to extinguish a source of fire before the fire spreads by providing at least one heat-sensing device attached to a CPU-controlled sprinkler, which upon detection of a heat signature, activates the sprinkler to selectively dispense water from a fire sprinkler system pipe or a fire suppressant contained within a canister from a nozzle directly aimed at the source of the heat signature. Because each sprinkler includes a separate heat-sensing device, only the sprinklers in specific area are activated. In addition, because the nozzle is directly aimed at the fire source, damage to items stored in the area is reduced when compared to other fire sprinkler systems which either activate all sprinklers simultaneously or activate sprinkler in a specific zone, but do not directly target the source of the fire. The present device also selectively dispenses water from the fire sprinkler fire system or a fire suppressant, as necessary for the particular type of item stored in the area of each sprinkler. Depending on the pre-set temperature at which the detection of a heat signature is set, the present system is capable of extinguishing a cigarette in a specific area, rather than spraying the entire area and the items stored in the area.

Thus has been broadly outlined the more important features of the present fire suppression system so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
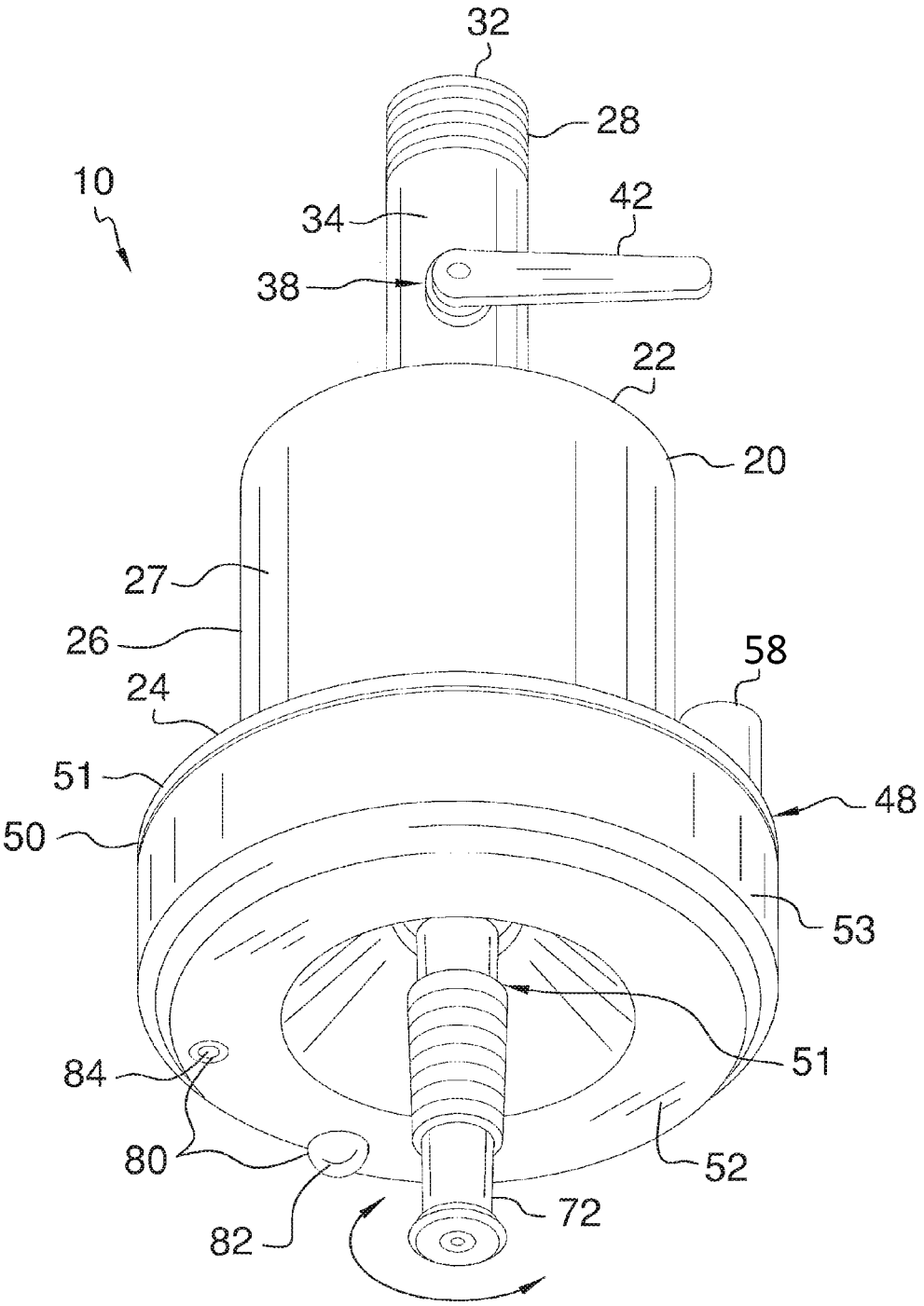
FIG. 1 is a front isometric view.
Figure 2:
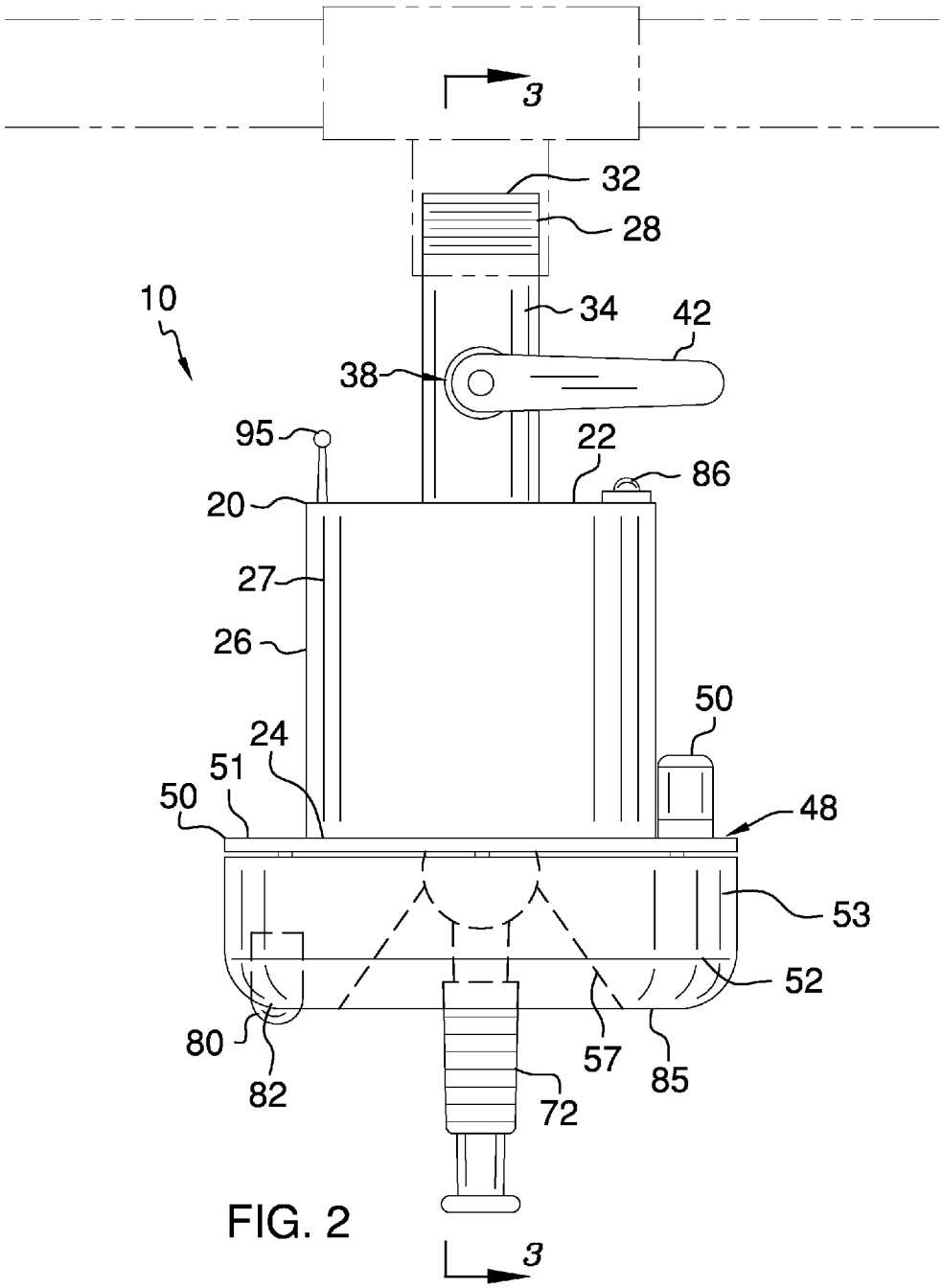
FIG. 2 is a front elevation view.
Figure 3:
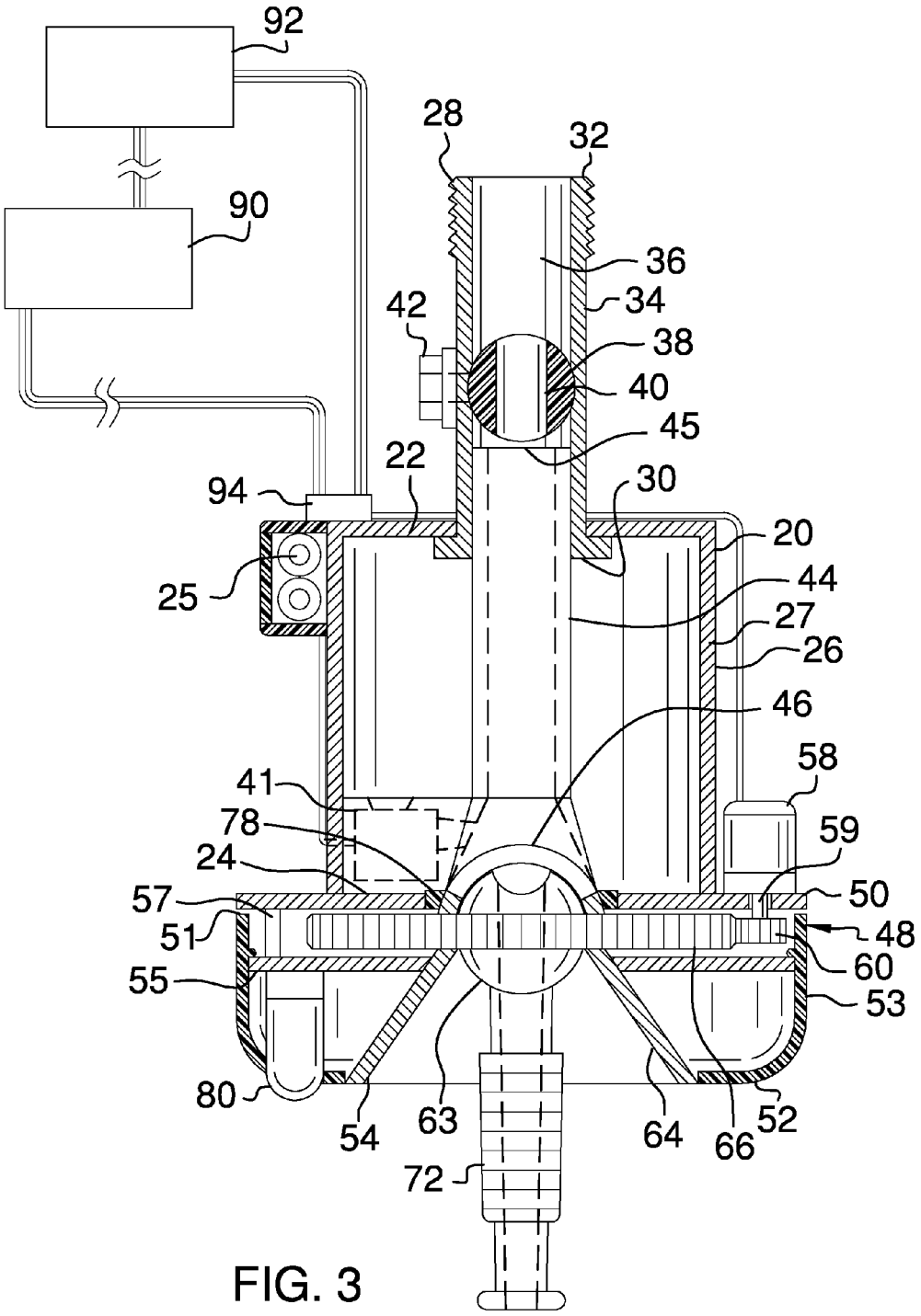
FIG. 3 is a cross-sectional view taken along line 3-3 of FIG. 2.
Figure 4:
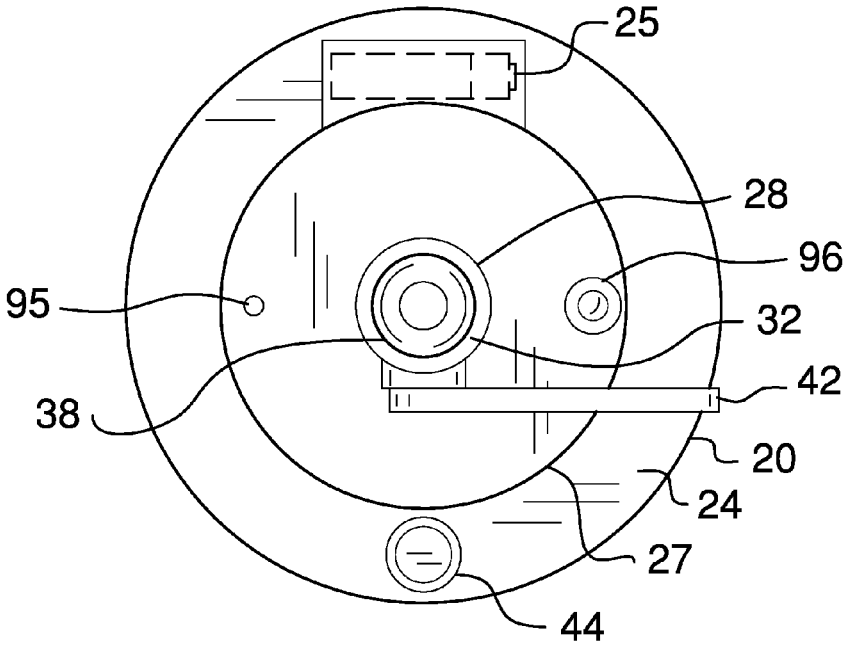
FIG. 4 is a top plan view.
Figure 5:
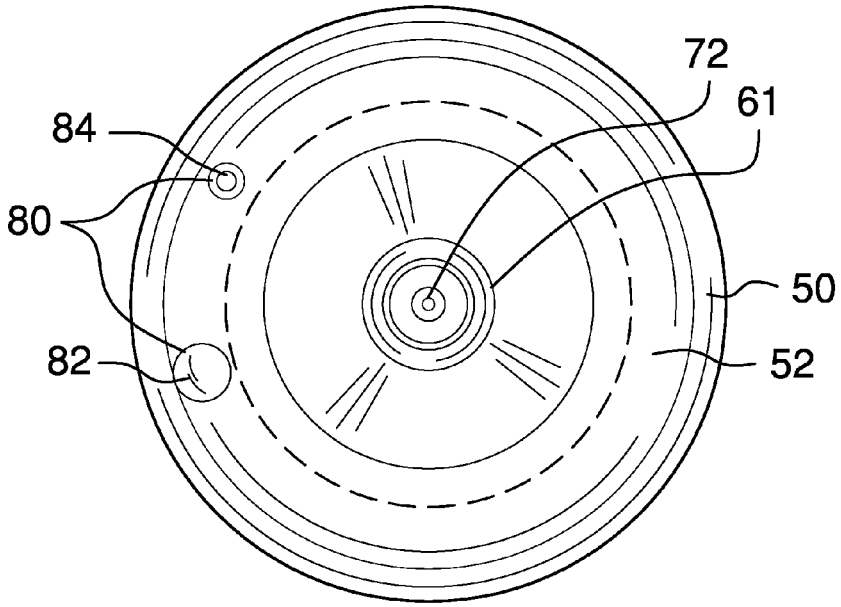
FIG. 5 is a bottom plan view.
Figure 6:
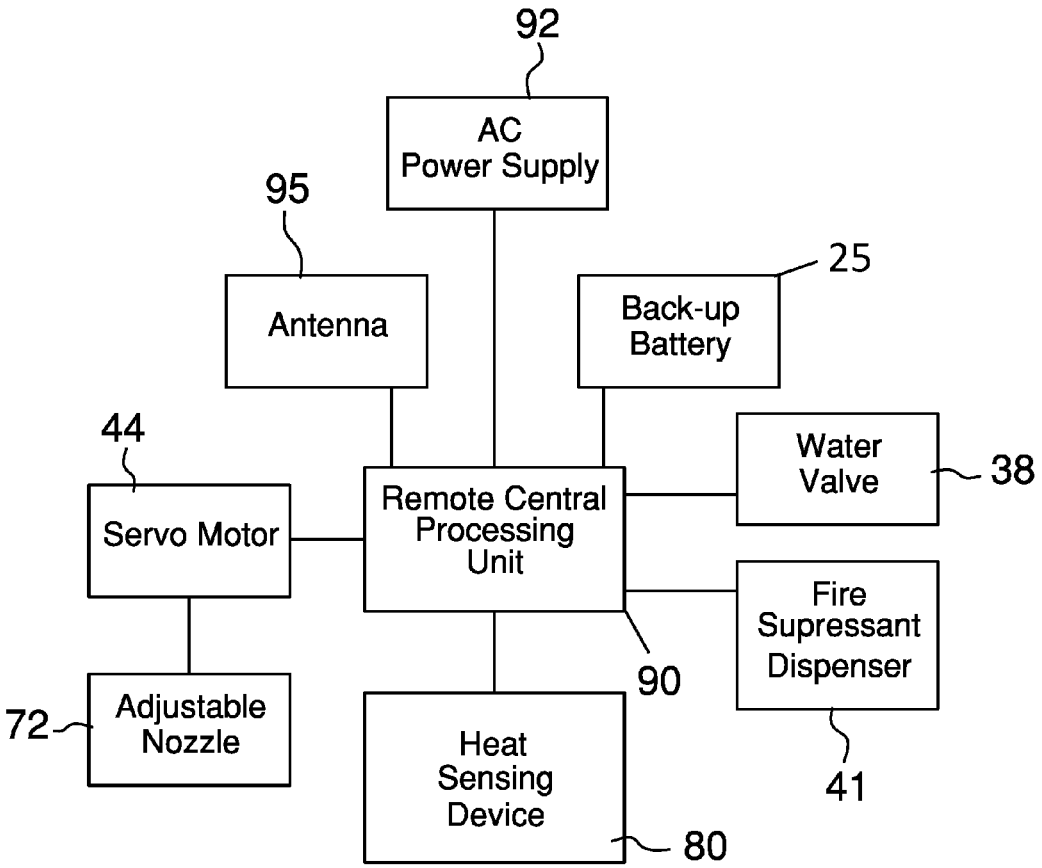
FIG. 6 is a block diagram of operations.

With reference now to the drawings, and in particular FIGS. 1 through 6 thereof, an example of the instant fire suppression system employing the principles and concepts of the present fire suppression system and generally designated by the reference number 10 will be described.

Referring to FIGS. 1 through 6 the present fire suppression system 10 is illustrated. The fire suppression system 10 includes at least one housing unit 20 having a top side 22, a bottom side 24, and a continuous outer wall 26 disposed between the top side 22 and the bottom side 24. A canister 27 is continuously disposed between the outer wall 26, the top side 22, and the bottom side 24. The canister 27 is configured to contain an amount of fire suppressant substance therein, such as a dry fire suppressant or a foam fire suppressant. A connection pipe 28 is provided to direct flow of water from a fire sprinkler system pipe therethrough. The connection pipe 28 has a bottom end 30, a top end 32, an exterior wall 34 continuously disposed between the bottom end 30 and the top end 32, and a longitudinal channel 36 continuously disposed between the bottom end 30, the top end. 32, and the exterior wall 34. The bottom end 30 is disposed within the housing unit 20 directly adjacent the top side 22. The top end 32 is fluidly connected to a fire sprinkler system pipe.

An on-off valve 38 is disposed within the channel 36 and has a conduit 40 therethrough. A flow-controlling mechanism 41 is disposed proximal to, in fluid communication with and in operational communication with the canister 27. A valve switch 42 is disposed on the exterior wall 34 directly adjacent the on-off valve 38, and is in direct operational communication with the on-off valve 38. The valve switch 42 engages the on-off valve 38 to move the on-off valve 38 from an open position with the conduit 40 being in parallel alignment with the channel 36 and to an alternate closed position with the conduit being perpendicular to channel 36. The fire sprinkler system pipe is in fluid communication with a flow pipe 44 when the on-off valve 38 is the open position as the flow pipe 44 is in fluid communication with the connection pipe 28. The flow pipe 44 is in alternate fluid communication with the flow-controlling mechanism 41 when the on-off valve 38 is in the closed position. The flow pipe 44 has an upper end 45 disposed within the channel 36 between the on-off valve 38 and the bottom end of the connection pipe 28. The flow pipe 44 further has a lower end 46 disposed proximal the bottom side 24 of the housing unit 20. A nozzle assembly 48 is disposed on the bottom side 24 of the housing unit 20.

A nozzle housing 50 is disposed on the bottom side 24 of the housing unit 20. The nozzle housing 50 has an upper side 51, a lower side 52, and an outer side 53 disposed between the upper side 51 and the lower side 52. Each of the upper side 51 and the lower side 52 has a central opening 54. A support bracket 55 is horizontally disposed within the nozzle housing 50 in a position parallel to the lower side 52 and proximal to the top side 51. A connection member 57 is disposed between and attached perpendicularly to the bottom side 24 of the housing unit 20 and the support bracket 55. A servo motor 58 is disposed on the nozzle housing 46 upper side 47 in a position opposite the connection member 57. The servo motor 58 has a positionable shaft 59 disposed through the upper side 51 of the nozzle housing 50 and a drive gear 60 disposed parallel to and proximal the upper side 51 of the nozzle housing 50. The shaft 59 is in operational communication with the drive gear 60. A ball and socket snap-fit joint 61 is rotatably disposed within the central opening 54 and extends between the bottom side 24 of the housing unit 20 and the lower side 52. The ball and socket snap-fit joint 61 has a ball 63 rotatably disposed within a frustoconical socket 64. The ball 63 is rotatable 360 degrees. A nozzle gear 66 is in direct operational communication with the drive gear 60 and the ball and socket snap-fit joint 61. A single central adjustable nozzle 72 is longitudinally disposed through the ball 63 and has a lowermost end 76 extending outwardly from the lower side 54 of the nozzle housing 50. The nozzle 72 is in direct fluid communication with the flow pipe 44. The flow pipe 44 dispenses an amount of water from the fire sprinkler system pipe through the connection pipe 28 and outwardly through the nozzle 72 and alternately dispenses the fire suppressant from the dispensing mechanism 41 and outwardly through the nozzle 62 as directed by the microprocessor.

A bushing 78 is disposed on the bottom side 24 of the housing unit 20 directly adjacent the central opening 54 to permit smooth rotation of the nozzle 72 with reduced vibrations which would otherwise be present.

A heat-sensing device 80 is disposed within the nozzle housing 50 proximal the lower side 52. The heat-sensing device 80 is configured to detect a heat signature at a pre-set temperature level. The heat-sensing device 80 is one of an infrared camera 82 and a laser tracker 84. A remote central processing unit 90 is in wireless operational communication with the heat-sensing device 80, the valve switch 42 and the flow-controlling mechanism 41. Upon the detection by the heat-sensing device 80 of the heat signature at the pre-set temperature level, the central processing unit 90 activates the servo motor 58. Upon activation of the servo motor 58, the nozzle 72 rotates as directed by the central processing unit 90 within the ball and socket snap-fit joint 61 toward the source of the heat signature. Upon detection by the heat-sensing device 80 of the heat signature at the pre-set temperature, the central processing unit 90 further selectively activates one of the valve switch 42 and the flow-controlling mechanism 41 depending upon the particular type of item stored proximal the heat-sensing device 80. When the valve switch 42 is activated by the central processing unit 90 and the on-off valve 38 is in the open position, the flow pipe 44 dispenses an amount of water from the fire sprinkler system pipe through the connection pipe 28 and outwardly through the nozzle 72. When the valve switch 42 is deactivated by the central processing unit 90 and the on-off valve 38 is in the closed position, the flow-controlling mechanism 41 alternately dispenses the fire suppressant substance from the canister 27 and outwardly through the flow pipe 44 and through the nozzle 72 as directed by the central processing unit 90.

A primary AC power source 92 is in operational communication with each of the central processing unit 90 and the servo motor 58. A wireless antenna 95 is in operational communication with the central processing unit 90. At least one battery 25 is disposed on the housing unit 20 to provide a back-up source of power. An automatic power source switch 94 is in operational communication with each of the at least one battery 25 and the primary AC power source 92. The automatic power source switch 94 selectively alternates the source of power from the primary AC power source 92 to the at least one battery 25 upon the failure of the primary AC power source 92.

A light emitting diode 96 is disposed atop the housing unit 20. The light emitting diode 96 is in operational communication with the power source switch 94. The light emitting diode 96 is configured to emit light when a source of power is provided through the power source switch 94 to the servo motor 58.

What is claimed is:

1. A fire suppression system comprising:

at least one housing unit having a top side, a bottom side, and a continuous outer wall disposed between the top side and the bottom side;

a canister continuously disposed between the outer wall, the top side, and the bottom side, wherein the canister is configured to contain an amount of fire suppressant substance therein;

a connection pipe having a bottom end, a top end, an exterior wall continuously disposed between the bottom end and the top end, and a longitudinal channel continuously disposed between the bottom end, the top end, and the exterior wall, the bottom end being disposed within the housing unit directly adjacent the top side, the top end being fluidly connected to a fire sprinkler system pipe;

an on-off valve disposed within the channel, the on-off valve having a conduit therethrough;

a flow-controlling mechanism disposed proximal to, being in fluid communication with, and being in operational communication with the canister;

a valve switch disposed on the exterior wall directly adjacent the on-off valve, the valve switch in operational communication with the on-off valve, wherein the valve switch engages the on-off valve to move the on-off valve from an open position with the conduit being in parallel alignment with the channel and to an alternate closed position with the conduit being perpendicular to channel;

a flow pipe in fluid communication with the connection pipe when the on-off valve is in the open position and in alternate fluid communication with the flow-controlling mechanism when the on-off valve is in the closed position, the flow pipe having an upper end disposed within the channel between the on-off valve and the bottom end of the connection pipe, the flow pipe further having a lower end disposed proximal the bottom side of the housing unit;

wherein the fire sprinkler system pipe is in fluid communication with the flow pipe when the on-off valve is the open position;

a nozzle assembly disposed on the bottom side of the housing unit, the nozzle assembly comprising:

a nozzle housing disposed on the bottom side of the housing unit, the nozzle housing having an upper side, a lower side, and an outer side disposed between the upper side and the lower side, each of the upper side and the lower side having a central opening;

a support bracket horizontally disposed within the nozzle housing in a position parallel to the lower side and proximal to the top side;

a connection member disposed between and attached perpendicularly to the bottom side of the housing unit and the support bracket;

a servo motor disposed on the nozzle housing upper side in a position opposite the connection member, the servo motor having a positionable shaft disposed through the upper side of the nozzle housing and a drive gear disposed parallel to and proximal the upper side of the nozzle housing, the shaft being in operational communication with the drive gear;

a ball and socket snap-fit joint rotatably disposed within the central opening and extending between the bottom side of the housing unit and the lower side, the ball and socket snap-fit joint having a ball rotatably disposed within a frustoconical socket, the ball being rotatable 360 degrees;

a nozzle gear in direct operational communication with the drive gear and the ball and socket snap-fit joint;

a single central adjustable nozzle longitudinally disposed through the ball and having a lowermost end extending outwardly from the lower side of the nozzle housing, the nozzle being in direct fluid communication with the flow pipe;

a bushing disposed on the bottom side of the housing unit directly adjacent the central opening;

a heat-sensing device disposed within the nozzle housing proximal the lower side, wherein the heat-sensing device is configured to detect a heat signature at a pre-set temperature level;

a remote central processing unit in wireless operational communication with the heat-sensing device, the valve switch and the flow-controlling mechanism, wherein upon the detection by the heat-sensing device of the heat signature at the pre-set temperature level, the central processing unit activates the servo motor, wherein upon activation of the servo motor, the nozzle rotates as directed by the central processing unit within the ball and socket snap-fit joint toward the source of the heat signature, wherein upon detection by the heat-sensing device of the heat signature at the pre-set temperature, the central processing unit further selectively activates one of the valve switch and the flow-controlling mechanism depending upon the particular type of item stored proximal the heat-sensing device;

a primary AC power source in operational communication with each of the central processing unit and the servo motor; and a wireless antenna in operational communication with the central processing unit;

wherein when the valve switch is activated by the central processing unit and the on-off valve is in the open position, the flow pipe dispenses an amount of water from the fire sprinkler system pipe through the connection pipe and outwardly through the nozzle; and wherein when the valve switch is deactivated by the central processing unit and the on-off valve is in the closed position, the flow-controlling mechanism alternately dispenses the fire suppressant substance from the canister and outwardly through the flow pipe and through the nozzle as directed by the central processing unit.

2. The fire suppressant system of claim 1 wherein the heat-sensing device is one of an infrared camera and a laser tracker.

3. The fire suppressant system of claim 1 further comprising:

at least one battery disposed on the housing unit; and an automatic power source switch in operational communication with each of the at least one battery and the primary AC power source, wherein the automatic power source switch selectively alternates the source of power from the primary AC power source to the at least one battery upon the failure of the primary AC power source.

4. The fire suppressant system of claim 1 further comprising a light emitting diode disposed atop the housing unit;

wherein the light emitting diode is in operational communication with the power source switch; and wherein the light emitting diode is configured to emit light when a source of power is provided through the power source switch to the servo motor.

* * * * *